US006945563B2

(12) United States Patent
Clausing

(10) Patent No.: US 6,945,563 B2
(45) Date of Patent: Sep. 20, 2005

(54) PUSH-ON TIP EXTENSION

(75) Inventor: Walter Clausing, Via Johannes Badrutt 15, Chesa Dura, 7500 St. Moritz (CH)

(73) Assignee: Walter Clausing, St. Mortiz (CH)

( * ) Notice: Subject to any disclaimer, the term of this patent is extended or adjusted under 35 U.S.C. 154(b) by 117 days.

(21) Appl. No.: 10/361,529

(22) Filed: Feb. 10, 2003

(65) Prior Publication Data

US 2003/0173769 A1 Sep. 18, 2003

(30) Foreign Application Priority Data

Feb. 8, 2002 (DE) ..... 202 01 963 U

(51) Int. Cl.[7] ..... A63C 11/00
(52) U.S. Cl. ..... 280/809; 280/811
(58) Field of Search ..... 280/809, 815, 280/601, 609, 608, 604, 811; 441/68, 74

(56) References Cited

U.S. PATENT DOCUMENTS

| | | | | | |
|---|---|---|---|---|---|
| 1,595,632 | A | * | 8/1926 | Taft | 280/601 |
| 3,066,326 | A | * | 12/1962 | Collins | 441/68 |
| 3,374,495 | A | * | 3/1968 | Joyce | 441/74 |
| 3,876,216 | A | * | 4/1975 | Wehr | 280/601 |
| 4,083,572 | A | * | 4/1978 | May, Jr. | 280/816 |
| 4,180,275 | A | * | 12/1979 | Montoya | 280/601 |
| 4,616,842 | A | * | 10/1986 | Echevin et al. | 280/602 |
| 4,792,316 | A | * | 12/1988 | Skedeleski et al. | 441/74 |
| 4,830,403 | A | * | 5/1989 | Ohmori | 280/815 |
| 4,955,314 | A | * | 9/1990 | Skedeleski et al. | 114/219 |
| D316,585 | S | * | 4/1991 | Skedeleski et al. | D21/776 |
| 5,174,220 | A | * | 12/1992 | Skedeleski et al. | 114/219 |
| 5,292,146 | A | * | 3/1994 | Palau | 280/601 |
| 5,310,221 | A | * | 5/1994 | Schmidt | 280/809 |
| 5,360,228 | A | * | 11/1994 | Palau | 280/609 |
| 5,397,153 | A | | 3/1995 | Dutaut et al. | |
| 5,435,589 | A | * | 7/1995 | Fagot | 280/610 |
| 5,649,722 | A | * | 7/1997 | Champlin | 280/818 |
| 5,664,808 | A | * | 9/1997 | Whidden et al. | 280/815 |
| 6,012,734 | A | * | 1/2000 | Skedeleski | 280/610 |
| 6,105,990 | A | * | 8/2000 | Sutherland | 280/604 |
| 6,264,215 | B1 | * | 7/2001 | Carlson et al. | 280/14.21 |
| 6,471,234 | B2 | * | 10/2002 | Ayliffe | 280/604 |
| 6,565,104 | B1 | * | 5/2003 | Colon | 280/87.042 |
| 6,604,755 | B2 | * | 8/2003 | Ayliffe et al. | 280/604 |

FOREIGN PATENT DOCUMENTS

| | | | | |
|---|---|---|---|---|
| DE | 2638928 A1 | | 8/1976 | A63C/5/04 |
| DE | 69300847 T2 | | 4/1993 | A63C/5/052 |
| EP | 0229608 A2 | * | 7/1987 | 280/809 |
| FR | 2685215 A1 | * | 6/1993 | 280/809 |

* cited by examiner

*Primary Examiner*—Christopher P. Ellis
*Assistant Examiner*—Jeff Restifo
(74) *Attorney, Agent, or Firm*—Head, Johnson & Kachigian

(57) ABSTRACT

An attachment or a set for the front end of a ski for multiple of purposes, such as extending upwardly the length of the ski and/or widening the ski end, the attachment may be of one piece or two pieces.

18 Claims, 6 Drawing Sheets

PUSH-ON TIP EXTENSION

I. FIELD OF USE

The invention concerns an attachment portion for the front end of skis.

II. TECHNICAL BACKGROUND

A problem which occurs with skis is that the configuration thereof, in particular what is referred to as the waisting or sidecut, that is to say the width of the ski in plan view and the changes thereof in the lengthwise region, theoretically should be very different, in particular in the front region, that is to say the shovel, in dependence on the ground underneath:

In the case of loose deep snow as occurs in particular in touring or cross-country ski runs the front end of the ski should project as far as possible upwardly above the base thereof in order to help the ski as it moves to float up on the surface of the loose snow and as far as possible to prevent it from diving in the snow. For the same reason it is also desirable for the front, upwardly projecting end of the ski to be of the largest possible width.

For skiing on normal prepared pistes and trails with a comparatively hard surface under the ski, in which there is no fear of the ski sinking into the snow, that is not necessary but on the contrary is even a hindrance as when for example the skis cross moving them back into the parallel condition is made difficult and an excessively large width of the skis in the front region prevents the skier from skiing in a close parallel stance.

In addition it must be pointed out that in the past it was already known for ski touring, in the event of the tip of the ski suffering breakage, generally in the event of the shovel of the ski breaking off, for the skier to carry a replacement portion in the form of a shovel which can be fitted on to a broken-off ski. That replacement shovel consisted of a sheet aluminum member and was so designed that it could only be fixed on to a broken-off end, which terminates straight, of a ski, but it could not be fixed on a shovel which is still present on the ski and which is of a curved configuration in the side view. That replacement shovel also did not serve to extend the shovel upwardly or to increase the width thereof, but it only served to provide a shovel which was of the same width and which projected upwardly to the same degree, in comparison with the broken-away shovel which was originally there.

III. STATEMENT OF THE INVENTION a) Technical Object

Therefore the object of the invention is to provide an attachment portion or a set consisting of skis and attachment portions, so that a normal ski, that is to say a ski which is dimensioned for preferably skiing on pistes or trails, as is nowadays generally sold and used, is extended upwardly in its upwardly projecting configuration and/or widened by means of the attachment portion.

Such an attachment portion, for a practical situation, must do the following:

- in the mounted condition withstand the loadings which occur while moving, in particular as regards fixing of the attachment portion to the ski,
- mounting of the attachment portion to the ski must be quick and easy to carry out, even under adverse conditions in deep snow on the piste or trail, and
- transportation of the attachment portion is to be easily possible, that is to say taking up a small amount of room, involving a slight risk of damage and with the attachment portion being low in weight.

A further problem is that the attachment portion must fit on to the front ends of the ski, in particular the shovels, which are dimensioned differently depending on the respective manufacturer and the model of the ski.

b) Attainment of the Object

That object is attained by the characterising features of claim 1. Advantageous embodiments are set forth in the appendant claims.

By virtue of the fact that the attachment portion can be fixed to the shovel of the ski it can be used to extend and/or widen an intact undamaged ski.

In particular an attachment portion can be produced and sold together with and thus adapted in respect of dimensioning to a given ski.

A wider outside dimension, in particular in respect of the running surface or base, of the attachment portion with respect to the widest location of the ski and in particular the shovel thereof means that the maximum width of the ski overall is increased and therewith the width of the trace which can be drawn in deep snow by the shovel of the ski and used by the rest of the ski.

By virtue of the attachment portion projecting upwardly beyond the tip of the ski and thus generally also somewhat forwardly, when travelling in loose snow, there is an increased likelihood that the tip of the ski, namely the tip of the attachment portion, is still above the surface of the snow while the ski is moving and thus the ski, when travelling on the loose snow, floats up by virtue of the inclined running surface of the attachment portion. This prevents the tip of the ski from cutting under the snow and thus digging into it, in loose deep snow.

For that purpose when considered in a side view the attachment portion can be of a straight configuration and then is connected only to the free end of the shovel of the ski, which end terminates straight.

Another possibility provides that the attachment portion in a side view is also of a curved configuration and in that case in particular the curvature approximately corresponds to the curvature of the shovel of the ski and also the attachment portion is fixed to the shovel in the region of the curvature of the shovel.

The curvature which is to be found both at the shovel and also the attachment portion and which as far as possible is the same in each case is then used for making a positively locking connection between those two parts.

Preferably in that case the attachment portion when fixed to the ski ends on the underside of the ski while still in the region of the shovel thereof, and does not extend down as far as the lower, substantially flat, horizontal region of the running surface or base of the ski. That ensures that, even when the attachment portion is mounted, it is possible to use the ski to negotiate a hard piste or trail without any problem.

The attachment portion itself can be in one piece or can comprise two halves which are preferably of a very substantially symmetrical configuration with respect to the longitudinal center of the ski and thus also the attachment portion. At its rear end which is towards the ski the attachment portion will have an opening for insertion of the shovel of the ski and for that purpose can be opened in the transverse direction, and in particular can be bent apart, either by virtue of the material elasticity in the connecting region when dealing with an attachment portion which is in one piece, or, in the case of a two-part configuration, by virtue of a movable, hinged connection which is then biased for example by means of a spring into the condition of being drawn together.

In order to provide a connection which is as secure as possible between the attachment portion and the ski, the attachment portion embraces at least the outer region of the underside of the ski, the outer narrow side and also a part of the top side, in positively locking relationship.

With a hinged connection between two separate side portions, the hinge is preferably of a separable nature and in particular is in the form of a fastener for closing the two side portions to each other. The side portions can be separated from each other by separation of the hinge and they can thus be transported individually and without taking up much space. For that purpose in particular the configuration of the side portions is so selected that they can be compactly fitted one into the other at least in part for transportation purposes. In particular in cross-section the individual side portions are of a U-shape or V-shape so that at least the mutually corresponding left side portions and the mutually corresponding right side portions can be fitted into each other and preferably also the left side portion can be fitted into the right side portion and vice-versa partially or indeed entirely.

Preferably a hook-and-loop fastener is used as the fastener for fastening the two side portions to each other and/or as the fastener for fastening the attachment portion with respect to the ski.

Another possibility—in particular when the attachment portion is of a one-piece nature—is a positively locking hole-pin connection which in particular consists of a hole on the longitudinal center line of the ski, in particular a through hole extending through the ski, and a pin on the attachment portion which engages into that hole from below or from above. In that case the pin can be divided into two halves which are associated with the two side portions, in the case of the one-piece configuration of the attachment portion just as in the case of the two-piece configuration thereof. Latching of the pin into the hole can be possible by virtue of the elasticity of the material of the attachment portion which for example is in the form of a plastic injection molding.

In the case of a two-part design configuration the side portions can also be produced in a U-shape from an aluminum extrusion and for example subsequently equipped with the necessary curvature.

Particularly when the attachment portion is of a one-piece nature the connecting location between the two sides of the attachment portion extends further rearwardly in the running surface or base than in the top side of the attachment portion. Nonetheless it is possible that this connecting location still terminates in the running surface in front of the front end of the shovel of the ski and thus there is on the longitudinal center line in the running surface an opening between the attachment portion and the ski, which then however is in particular only in the form of a narrow slot.

The connecting location in the running surface can in particular also be in the form of a thin-walled downwardly and outwardly curved configuration in the running surface which thus by virtue of the outwardly bent configuration permits easy deformability of the attachment portion.

In addition the underside of the attachment portion may be provided with a fin which extends in the longitudinal direction and which serves in particular to break up a hard surface of the subjacent ground with softer layers therebeneath. The fin preferably extends in the longitudinal direction and is disposed either on the longitudinal center of the attachment portion or symmetrically in relation thereto in a twinned design to the left and the right of the attachment portion. The fin will generally project downwardly from the underside of the attachment portion no further than between about 1 and 3 centimeters and will begin at the foremost end of the attachment portion and will be of its greatest height near the foremost end and will become lower rearwardly and in so doing will terminate in particular before the rear end of the attachment portion. In cross-section the fin can be in the shape of a perpendicularly disposed plate of approximately uniform wall thickness or it can also be of a V-shape with increasing cross-section towards the attachment portion, in which case in particular the transitions between the fin and the attachment portion are greatly rounded in order to improve stability. Furthermore it will be appreciated that such a fin improves straight-ahead running of the skis, in particular in loose deep snow.

c) Embodiments by Way of Example

An embodiment according to the invention is described in greater detail by way of example hereinafter with reference to the drawings in which:

FIG. 1*a* is a side view of a first embodiment,

FIG. 1*b* is a side view of a second embodiment,

FIG. 2*a* shows a view from below of the first embodiment,

FIG. 2*b* shows a view from below of the second embodiment,

FIG. 3*a* shows a view from above of the first embodiment,

FIG. 3*b* shows a view from above of the second embodiment,

Figure 2B:
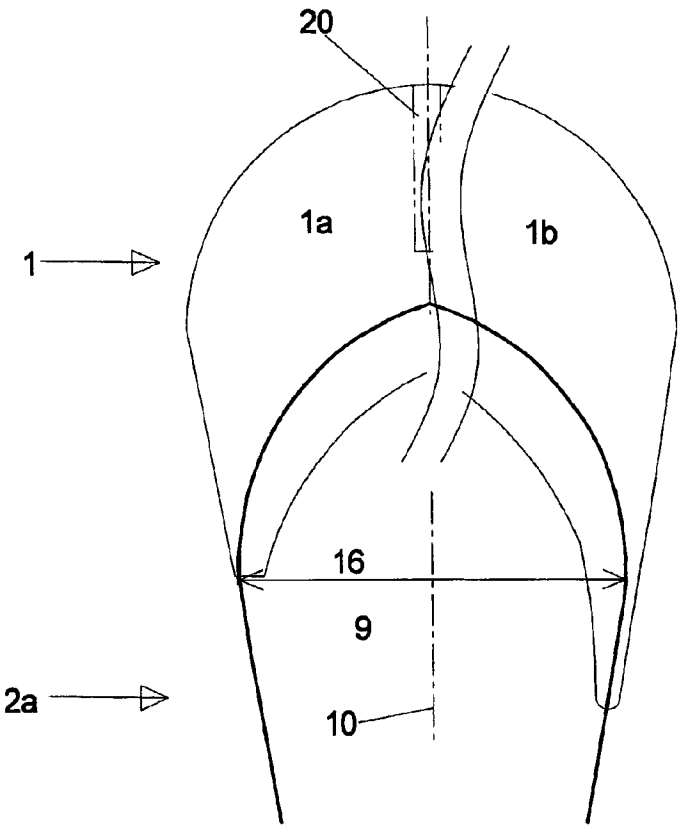
Figure 2A:
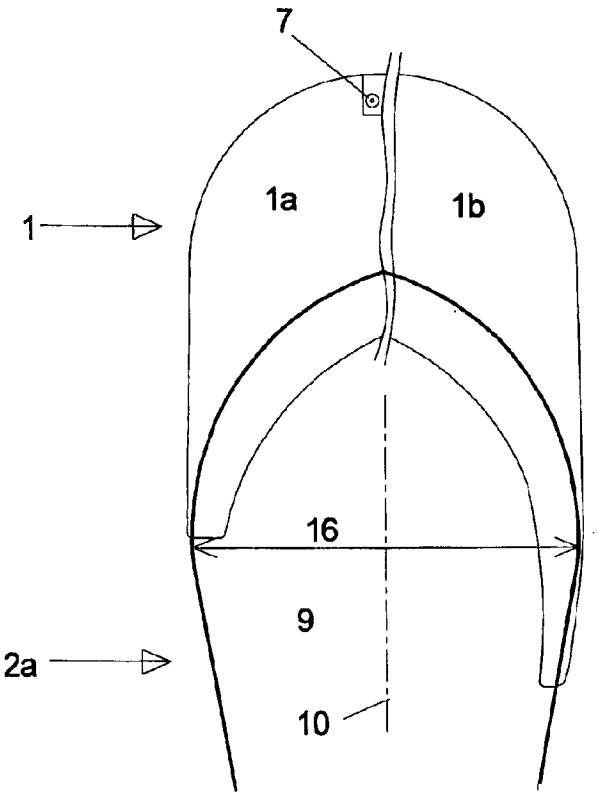
Figure 3B:
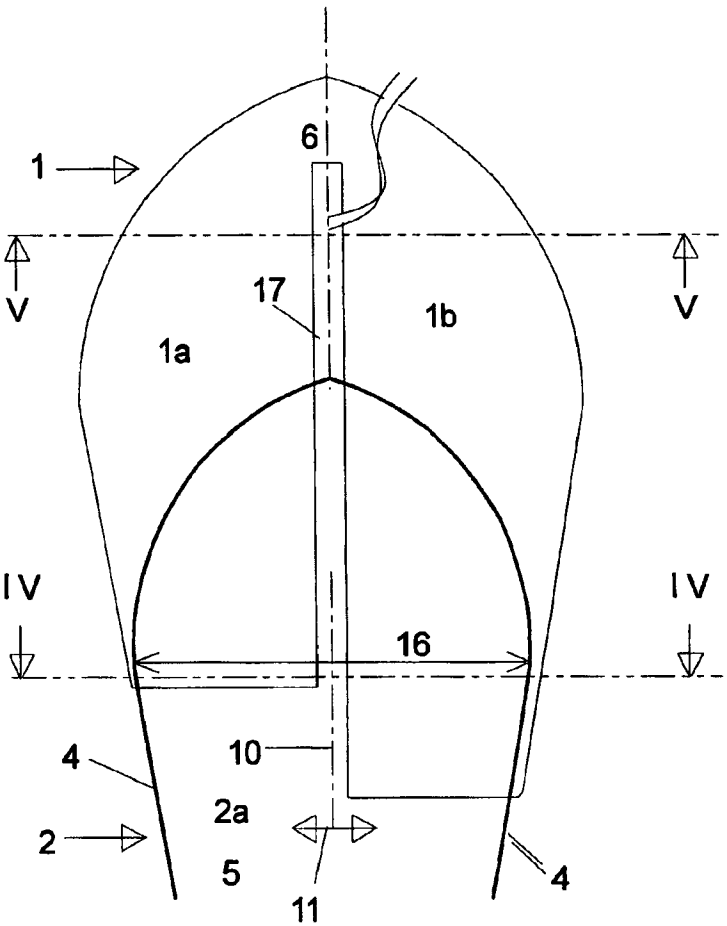
Figure 3A:
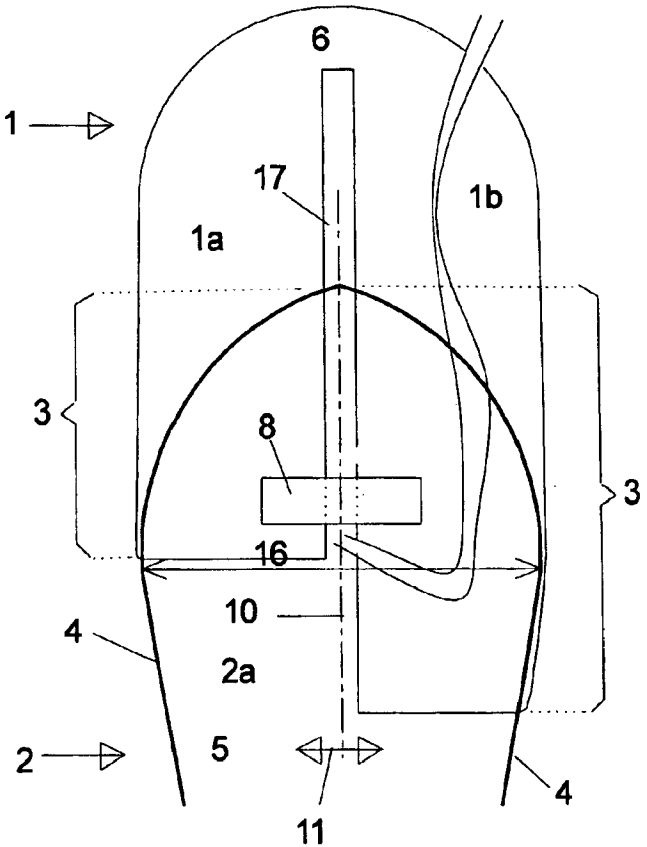

In the following Figures, in the views from below and above (FIGS. 2 and 3), each of FIGS. 2*a* and 3*a* show attachment portions which substantially only prolong the ski beyond its front end, while FIGS. 2*b* and 3*b* show variants which also increase the width of the ski in relation to its widest location 16 which is generally at the shovel.

In addition the left and right halves of the views each show two different variants to the effect that:

- in the left-hand half of the illustration the attachment portion extends rearwardly at a maximum as far as the widest location 16 of the shovel 2*a* of the ski 2, whereas
- in the right-hand half of the view the attachment portion 1 extends rearwardly beyond the widest location 16 so that a positively locking effect between the ski 2 and the attachment portion 1 is already achieved solely by virtue of the widest location being embraced by the attachment portion in that way.

In addition the width-increasing versions shown in FIGS. 2*b* and 3*b*show that the widest location of the attachment portion 1 is preferably in front of the tip of the ski 2 and the side edges of the attachment portion 1 preferably blend without a bend or a step into the side edges or narrow sides 4 of the skis 1.

The views from below as in FIGS. 2*a* and *b* show that the attachment portions 1 overlap the edge region of the running surface 9 of the ski, which adjoins the narrow sides 4, only relatively slightly, that is to say to a width of between about 1 and 2 centimeters, so that the running surface or base 9 of the ski is covered over as little as possible, by the underside of the attachment portion 1 which generally has less good slidability. Nonetheless it is possible for the running surface or base 9 to be covered over by the underside of the attachment portion 1 as far as the rearmost end of the latter.

Figure 4:
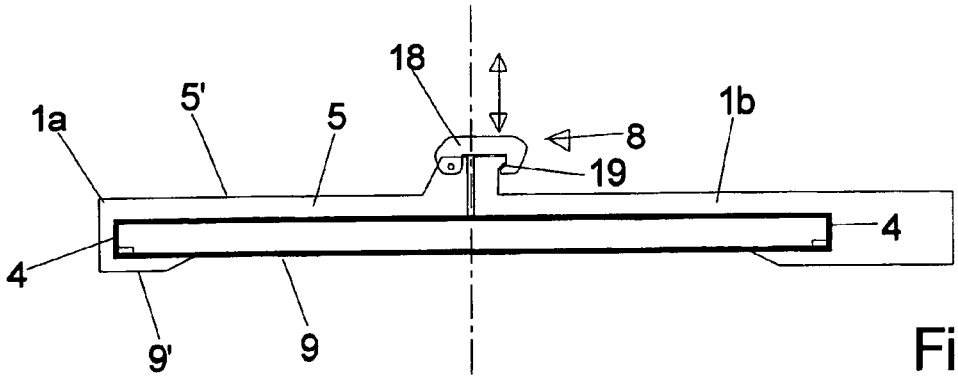
FIG. 4 shows a view in section taken along line IV—IV.

The views on the top side of the attachment portion in FIG. 3 show that the top sides of the side portion 1*a*, 1*b* which—as is best shown in FIG. 4—is U-shaped in cross-section also extend towards each other in the rear region except for a narrow gap or slot 17 so that the two side portions 1*a, b* of the attachment portion are held together by means of a fastener 8.

While FIGS. 3*a* and 3*b* show the one-piece configuration of the attachment portion 1, in which the side portions 1*a, b* are connected together in the front region by way of a connecting location 6, wherein said connecting location 6 is only a fraction, at a maximum about 5 centimeters in the longitudinal direction 10, in order to permit the side portions 1*a, b* to bend open for being pushed on to the ski 1, FIG. 2*a* shows the two-part variant:

In this case the two side portions 1*a, b* are connected together by way of a hinge 7, in particular a pivot axis, in the front region of the attachment portion, and for that purpose preferably overlap somewhat in that region.

In that case the hinge 7 is preferably biased into the direction of pressing the side portions 1*a, b* against each other.

The fastener 8 which is preferably arranged on the top side of the attachment portion 1 can be of any kind of mechanical fastener, but also a simple hook-and-loop band which is fixed on at least one of the side portions 1*a, b* by means of a hook-and-loop fastener and which is easy to release.

FIG. 4 is a cross-sectional view showing the two halves, which are each U-shaped, of the two side portions 1*a, b* of the attachment portion 1, the internal free space of which is so dimensioned that it can embrace around the outer region of the ski 2, that is to say the edge region of the running surface or base 9 thereof, the narrow Side 4, and also at least a part of the top side 5.

In FIG. 4 the fastener 8 is shown in the form of a detent or latching fastener in which a latching pawl 18 is fixed to a side portion 1*a* pivotably in a transverse plane and can be pivoted down into a position of engaging behind a nose 19 on the other side portion 1*b* after the two side portions 1*a* are fixed in the desired position on the ski 2.

Figure 1A:
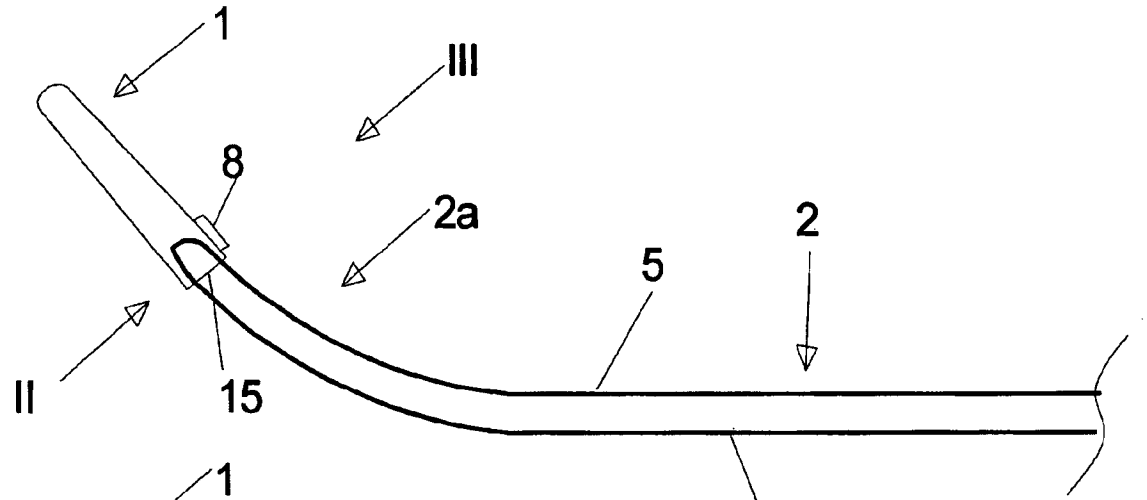
Figure 1B:
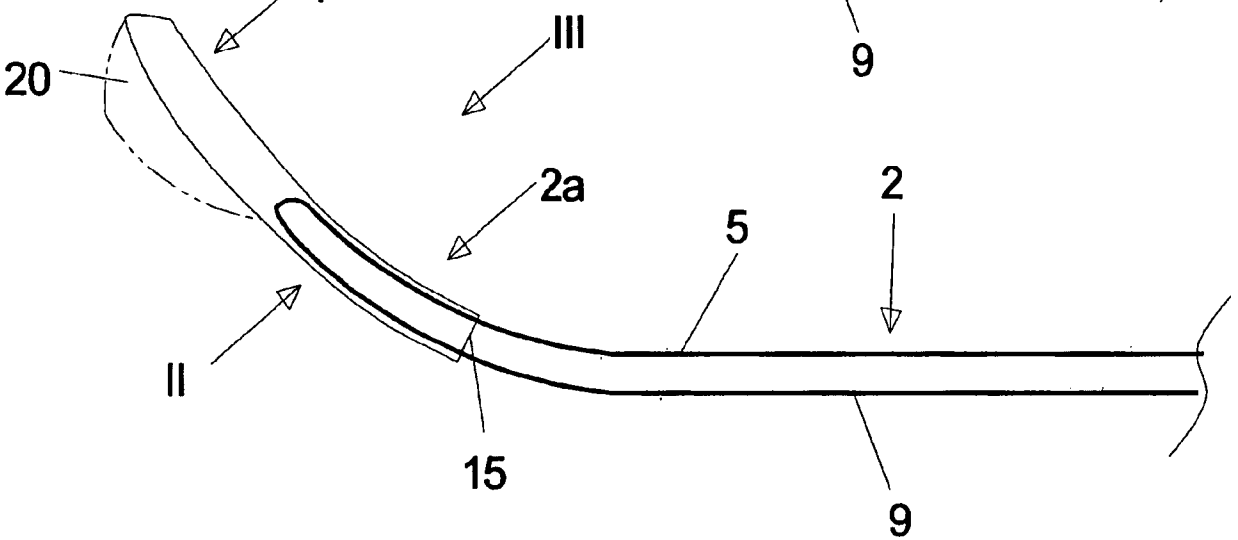

In this respect the side view in FIGS. 1*a* and 1*b* shows that, for assuming the desired position, it is necessary to proceed differently depending on whether the side portion 1 is only fitted on the foremost end region, which in the side view is straight or scarcely still curved, of the shovel 2*a* of the ski 2, as shown in FIG. 1*a*, or whether, as considered in the side view, it extends back into the shovel 2*a* to such an extent that the attachment portion 1 itself must have a curvature in the side view, corresponding to the curvature of the shovel 2*a*, as shown in FIG. 1*b*.

While in the first-mentioned case as shown in FIG. 1*a* the attachment portion can be simply pushed from the front and from above on to the free front end of the shovel 2*a*, in the second variant shown in FIG. 1*b* lateral fitment of the two side portions 1*a*, 1*b* is the most appropriate procedure:

For that purpose however it must be possible for the two side portions to be moved in the transverse direction to a position in which they are at a greater spacing from each other, than in the mounted condition. In the two-part configuration that is possible by means of the hinge 7 or in the case of the one-part embodiment that is possible by suitable stretchability of the material of the attachment portion 1 in the connecting region 6.

Figure 5:
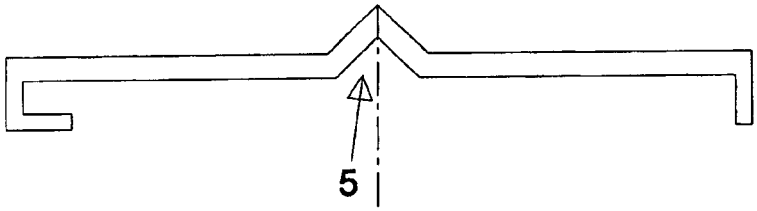
FIG. 5 shows a view in cross-section taken along line V—V.

For that purpose the connecting region 6 either comprises a very elastic material such as for example rubber or the connecting region 6—as shown in FIG. 5—is curved upwardly in a V-shape or U-shape at the center, with a wall thickness which is as small as possible, which thereby makes it easier to effect a stretching operation in the transverse direction if the material used for that purpose is still sufficiently flexible, which is still generally the case with plastic material.

FIG. 5 further shows the two variants in the two outwardly disposed regions, namely showing that the attachment portion in its edge region can be of a double cranked configuration in a U-shape in its edge region, as is also to be preferred in the lengthwise region of the ski which is disposed therein, or it can have only a single crank configuration, which additionally reduces the amount of material required and thus the weight involved.

Figure 6:
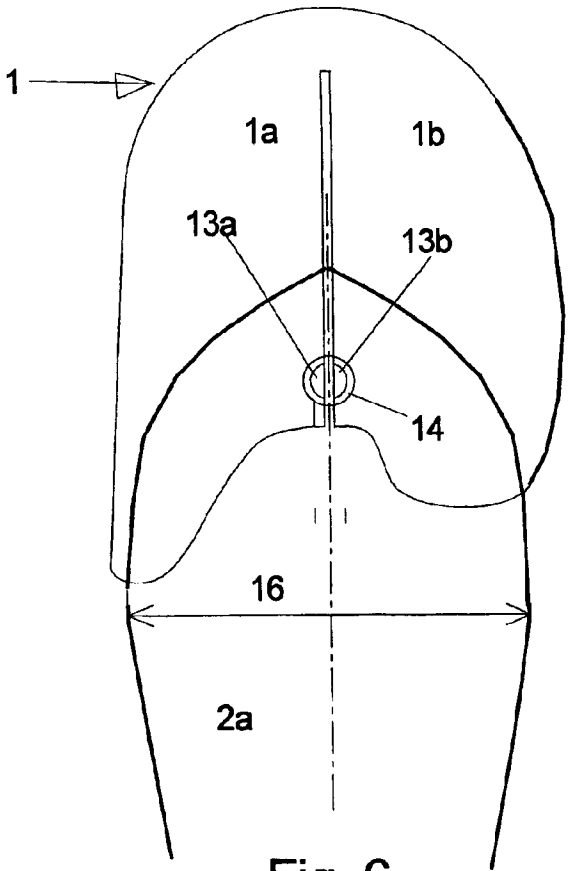
FIG. 6 shows a view from above of a further configuration.

FIG. 6—in a view from above or below—further shows a positively locking kind of fixing between the attachment portion 1 and the ski 2, in which provided in the ski 2—preferably on the longitudinal center line 10 thereof—is a hole 14 into which engages a pin 13 of the attachment portion 1. In this case the pin 13 is preferably divided into two half pin portions 13*a*, 13*b* of which one is formed in one piece together with the one side portion 1*a* and the other with the other side portion 1*b*.

When the attachment portion is pushed on those pin portions 13*a*, 13*b* engage into the hole 14 which can also be a hole through the body of the ski, and are held there by virtue of the resilient return force of the material of the attachment portion 1. The pin 13 or the pin portions 13*a*, 13*b* can in this case project into the hole from the lower part of the attachment portion and from the upper part thereof.

Figure 7:
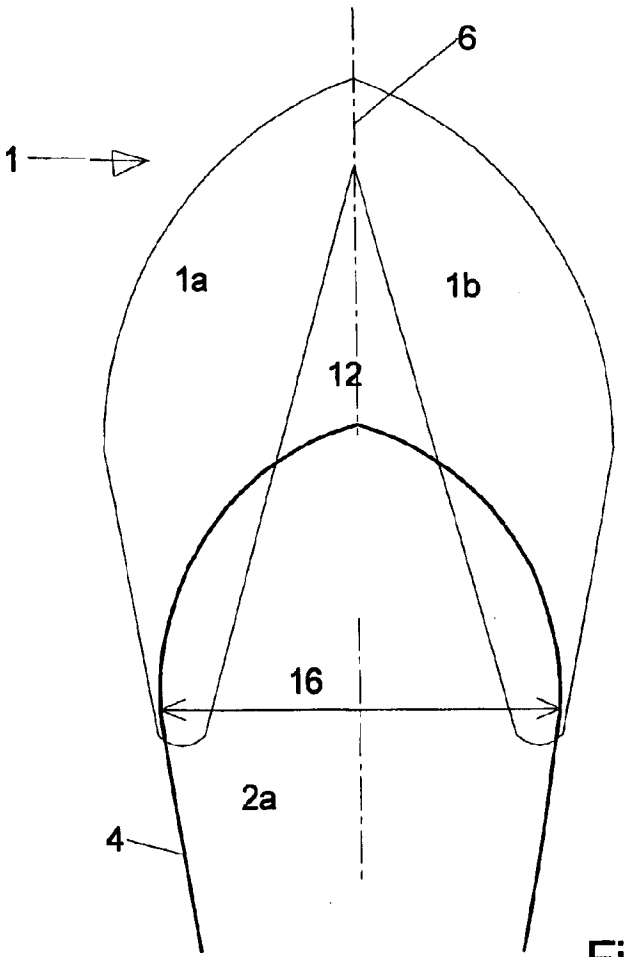
FIG. 7 shows a view from below of a further configuration.

FIG. 7 further shows a variant in which the connecting region 6 of the attachment portion 1 which in this case is of a one-piece configuration is far in front of the front end of the ski in the mounted condition. By virtue of a correspondingly narrow configuration of the side portions 1*a*, 1*b*, including in the lower part of the attachment portion, that is to say at the running surface or base, there is an opening 12 in the running surface between the two side portions 1*a, b*, and thus preferably also in the entire attachment portion which is preferably only in the form of a narrow slot in the running surface or base, whereas in the top side of the attachment portion it can be markedly wider without any problems, for example it can be of a configuration which increases in width from the front rearwardly in a V-shape.

Figure 8:
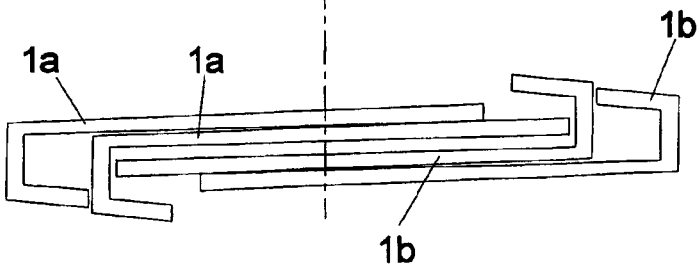
FIG. 8 shows a view in section of side portions which are inserted one into the other.

Production of the attachment portion 1 in the two-part variant, that is to say comprising two side portions 1*a, b* which can be separated at the connecting location, when the side portions are of a generally U-shaped cross-sectional configuration, makes it possible in particular to provide for space-saving mutual nesting at least of the two corresponding side portions 1*a* and the corresponding side portions 1*b* of two attachment portions 1 which are required for a pair of skis, as shown in FIG. 8.

In addition those side portions which are nested into each other in pairs can be fitted in part into each other in general to save space by being at least partially pushed one into the other, by a procedure whereby the long limbs of the U-shape which generally form the top side of the attachment portion are laid against each other in such a way that the cranked outer regions of the pairs of side portions face away from each other, and in each pair the cranked outer regions fit one into the other.

In addition the structures in FIGS. 1*b* and 2*b* show the possibility of having a fin 20 which can be present in each structural configuration of the attachment portion. The fin 20 serves for cutting through a hard, frozen cover layer on the snow and therefore on the one hand must be of a sufficiently sharp and strong design, while on the other hand the fin 20 must be so greatly rounded as to exclude the possibility of injury from the fin 20.

The side view in FIG. 1*b* shows that the fin 20 begins at the foremost end of the attachment portion 1, there very quickly reaches the greatest height of projecting downwardly from the underside of the rest of the attachment portion 1, and from there becomes slowly shallower in a rearward direction. The fin 20 preferably extends only into the region of the tip of the ski 2 and therefore still terminates before the rear end of the attachment portion 1.

FIG. 2*b* shows the arrangement of such a fin 20 on the longitudinal center line 10. Equally however it is also possible for two such fins 20 to be provided in mutually symmetrical relationship on both sides of the longitudinal center line in each of the side portions 1*a, b*, even when the attachment portion is of a one-piece configuration, and it is even possible to arrange only a single fin 20 which however is at an off-center position.

Figure 9C:
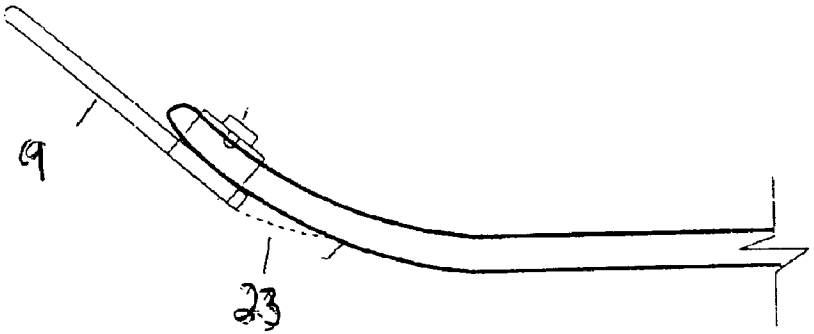
FIGS. 9*a*–9*c* shows an embodiment close to a mass-produced article.
Figure 9B:
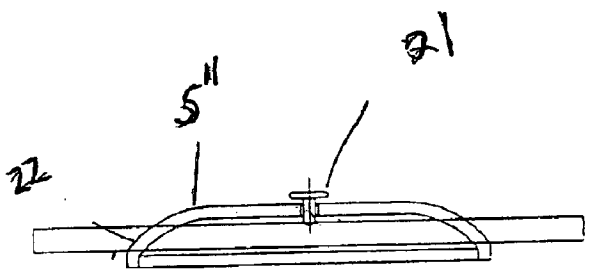
Figure 9A:
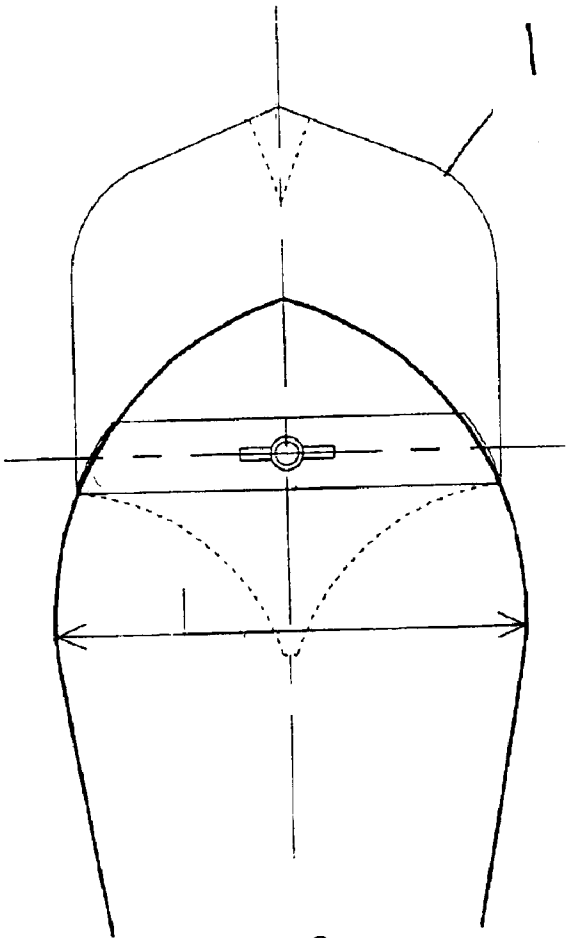

Such a fin 20 can also be provided in the embodiment shown in FIGS. 9*a* through *c*, which is close to a mass-produced article and which has the following particularities in comparison with the previous design configurations:

The attachment portion 1—except for the clamping screw 21—is formed in one piece, preferably in the form of an injection molding of plastic material.

In this case the running surface 9" extends over the entire width of the attachment portion 1, and not only in the edge regions for engaging under the ski, while on the top side of the ski only a top side 5" of the attachment portion 1 extends in the form of a transverse bridge which goes with its two lateral ends into the running surface 9. That transitional region 22 is inclinedly disposed in each case so that the two transitional regions 22 converge inclinedly forwardly, corresponding to the outer edges, which extend inclinedly towards each other, in a ski tip, in the front region thereof. That serves to apply the edges of a ski tip over the longest possible length within that transverse bridge 5!.

Correspondingly the attachment portion also preferably extends rearwardly and downwardly from the front tip of the ski only to such an extent that it no longer reaches the curved shovel region of the ski.

Correspondingly the rear end of the top side, that is to say the transverse bridge 5", of the attachment portion 1 is still in front of the widest location of the shovel of the ski, that is to say in the region of the ski tip which generally is just directed upwardly.

The running surface 9 of the attachment portion 1 terminates rearwardly preferably under the rear end of the transverse bridge 5", but in addition it can also be extended rearwardly, preferably only in the central region thereof, in the form of a tail extension 23 which is extended rearwardly beneath the running surface or base of the ski in order to increase the contact length—along the longitudinal center line 10—between the attachment portion 1 and the ski 2 and thus to improve the connection therebetween.

The attachment portion is fixed to the ski 2 by means of a clamping screw 21 which is screwed from above through a screwthreaded bore in the transverse bridge 5", preferably in the center thereof, and which bears against the top side of the ski, and there preferably engages into a small recess in the form of a blind hole and, when the clamping screw is tightened, thus pulls the running surface 9 of the attachment portion 1 against the running surface of the tip of the ski.

LIST OF REFERENCES0

1 attachment portion
1*a, b* side portion
2 ski
2*a* shovel
3 fixing region
4 narrow side
5, 5' top side
6 connecting region
7 hinge
8 fastener
9 running surface
10 longitudinal center line
11 transverse direction
12 opening
13 pin
13*a, b* pin portion
14 hole
15 insertion opening
16 widest location
17 slot
18 latching pawl
19 nose
20 fin
21 clamping screw
22 transitional region
23 tail extension

What is claimed is:

1. An attachment device for use on a ski having a shovel-shaped front end, an underside having a running surface, a top side, first and second narrow edges, and a predetermined length, said device comprising:

two identical side portions each portion having front and rear ends, first and second side edges, top and an underside portion;

connections means for attaching to the shovel-shaped front end of a ski;

a connection location wherein said two identical side portions are connected at said connection location by a hinge; and said device being configured for extending the length of a ski.

2. An attachment device according to claim 1 wherein said shovel-shaped front end of the ski has a predetermined width and wherein said attachment device is wider than the shovel-shaped front end of the ski.

3. An attachment device according to claim 1 wherein said device extends the ski upwardly and forwardly.

4. An attachment device according to claim 1 wherein when said device is mounted it embraces the ski at the outer narrow sides and on the top side of the ski.

5. An attachment device according to claim 1 wherein said device is made from the group consisting of an injected molding, including plastic material, and an extrusion profile, including light metal.

6. An attachment device according to claim 1 wherein said underside portion is a fin extending in a longitudinal direction and projecting downwardly and beginning at the front end of said device and extending rearwardly with a decreasing height and ending in front of said rear end of said device.

7. An attachment device according to claim 6 wherein said fin, as seen in cross-section, is V-shaped with an increasing width towards the rest of said attachment device.

8. An attachment device according to claim 6 wherein said fin is of a plate-shaped configuration of a thickness which remains approximately the same.

9. An attachment device according to claim 1 wherein said device ends at least on the underside of a ski while still in the shovel-shaped region, that is, in front of the lower, substantially straight running surface of a ski.

10. An attachment device according to claim 1 wherein said connection location ends in the running surface of a ski in front of the shovel-shaped front.

11. An attachment device according to claim 1 wherein said connection location has a narrow opening on a longitudinal center line between said attachment device and the ski.

12. An attachment device according to claim 1 wherein said connection location is in the form of a downward and outward thin-wall curvature configuration of the running surface, with the consequence that it can be easily flexed open in a transverse direction.

13. An attachment device according to claim 1 wherein said rear end has an insertion opening in the transverse direction for inserting the shovel-shaped front end of the ski therein.

14. An attachment device according to claim 1 wherein said connection location extends further rearwardly in the ski running surface of the device than in the top side.

15. An attachment device according to claim 1 wherein said hinge is biased into the position of pulling the two side portions against each other.

16. An attachment device according to claim 1 wherein said hinge is separable and is in the form of a fastener.

17. An attachment device according to claim 16 wherein a fastener is arranged between the two side portions near the rear free end thereof on the top side of the attachment device.

18. An attachment device according to claim 16 wherein said fastener is a hook-and-loop fastener.

* * * * *